US008495841B2

(12) United States Patent
DeGroff

(10) Patent No.: US 8,495,841 B2
(45) Date of Patent: Jul. 30, 2013

(54) WINDOW ASSEMBLY FOR VEHICLE

(75) Inventor: Gary DeGroff, Holland, MI (US)

(73) Assignee: Magna Mirrors of America, Inc., Holland, MI (US)

( * ) Notice: Subject to any disclaimer, the term of this patent is extended or adjusted under 35 U.S.C. 154(b) by 186 days.

(21) Appl. No.: 12/850,871

(22) Filed: Aug. 5, 2010

(65) Prior Publication Data

US 2011/0030277 A1 Feb. 10, 2011

Related U.S. Application Data

(60) Provisional application No. 61/232,250, filed on Aug. 7, 2009.

(51) Int. Cl.
*E06B 1/04* (2006.01)
*E06B 7/16* (2006.01)
*E05D 15/16* (2006.01)

(52) U.S. Cl.
USPC .. 52/207; 52/204.51; 52/204.71; 52/204.595; 49/413; 49/380; 296/146.15; 296/146.16; 296/178

(58) Field of Classification Search
USPC ..... 49/413, 380; 52/207, 204.1, 204.5, 52/204.51, 208, 204.71, 204.7, 204.62, 204.6, 52/204.591, 204.595; 296/146.15, 146.16, 296/178, 201
See application file for complete search history.

(56) References Cited

U.S. PATENT DOCUMENTS

| | | | | |
|---|---|---|---|---|
| 1,637,367 A | | 8/1927 | Zimmers et al. | |
| 2,023,699 A | | 12/1935 | Robinson | |
| 2,455,462 A | | 12/1948 | Bader et al. | |
| 2,502,320 A | | 3/1950 | Guernsey | |
| 2,762,648 A | | 9/1956 | Huzzard | |
| 2,772,915 A | * | 12/1956 | Renno | 296/93 |
| 2,814,525 A | * | 11/1957 | Thomas | 296/93 |
| 2,820,992 A | | 1/1958 | Clayton-Wright | |
| 3,186,755 A | | 6/1965 | Ward | |
| 3,283,455 A | * | 11/1966 | Riegelman | 52/207 |
| 3,442,059 A | * | 5/1969 | Kessler | 52/204.595 |
| 3,742,649 A | * | 7/1973 | Dochnahl | 49/441 |
| 4,042,004 A | * | 8/1977 | Kwan | 160/91 |
| 4,072,338 A | | 2/1978 | Lawrence et al. | |

(Continued)

FOREIGN PATENT DOCUMENTS

| | | | |
|---|---|---|---|
| DE | 3118559 A1 | * | 11/1982 |
| EP | 968862 A2 | * | 1/2000 |

(Continued)

*Primary Examiner* — Basil Katcheves
*Assistant Examiner* — Rodney Mintz
(74) *Attorney, Agent, or Firm* — Gardner, Linn, Burkhart & Flory, LLP

(57) ABSTRACT

A window assembly for a vehicle includes a frame configured to mount to a transit vehicle, a fixed window panel affixed to a portion of the frame, and a movable window assembly having a movable window panel circumscribed by a movable frame. The movable frame has opposite end members and a pair of opposite slide rail members. The slide rail members are slidably received in respective channels along opposite portions of the frame. Each of the slide rail members includes a co-extruded slide rail having a semi-rigid or rigid rail portion, a flexible window seal co-extruded with the rail portion for sealing against the movable window panel, and a flexible sliding seal co-extruded with the rail portion for slidably engaging the opposite portions of the frame when the movable window assembly is assembled to the frame and is moved between its opened and closed positions.

20 Claims, 4 Drawing Sheets

U.S. PATENT DOCUMENTS 4,119,341 A 10/1978 Cook
4,343,121 A * 8/1982 Kruschwitz et al. ..... 52/208
4,364,214 A 12/1982 Morgan et al.
4,364,595 A 12/1982 Morgan et al.
4,405,175 A * 9/1983 Hoffmann ..... 296/201
4,431,228 A 2/1984 Grise
4,454,688 A 6/1984 Rest et al. ..... 49/502
4,530,192 A * 7/1985 Ginster ..... 52/204.591
4,561,224 A * 12/1985 Jelens ..... 52/207
4,604,830 A 8/1986 Maeda et al. ..... 49/374
4,608,779 A 9/1986 Maeda et al. ..... 49/374
4,619,479 A 10/1986 Martin, Jr.
4,656,784 A 4/1987 Brachmann ..... 49/491
4,703,598 A * 11/1987 Wilson et al. ..... 52/238.1
4,785,583 A * 11/1988 Kawagoe et al. ..... 49/404
4,793,099 A 12/1988 Friese et al.
4,833,847 A * 5/1989 Inayama et al. ..... 52/208
4,875,307 A 10/1989 Barbero ..... 49/374
4,932,161 A 6/1990 Keys et al. ..... 49/491
5,040,333 A 8/1991 Mesnel et al. ..... 49/374
5,054,242 A 10/1991 Keys et al. ..... 49/491
5,069,497 A * 12/1991 Clelland ..... 296/155
5,139,307 A 8/1992 Koops et al. ..... 296/201
5,169,205 A 12/1992 James
5,228,740 A * 7/1993 Saltzman ..... 296/146.1
5,273,338 A * 12/1993 Gooding et al. ..... 296/146.15
5,345,717 A 9/1994 Mori et al. ..... 296/146.16
5,345,719 A 9/1994 Karwande ..... 49/502
5,355,651 A * 10/1994 Correia ..... 52/716.7
5,421,125 A * 6/1995 Camp et al. ..... 49/404
5,429,844 A * 7/1995 Galardi ..... 428/31
5,441,688 A * 8/1995 Goto et al. ..... 264/167
5,442,880 A 8/1995 Gipson
5,456,049 A * 10/1995 Goto et al. ..... 52/208
5,522,191 A * 6/1996 Wenner et al. ..... 52/204.51
5,551,197 A 9/1996 Repp et al. ..... 52/204.62
5,566,510 A 10/1996 Hollingshead et al. ..... 49/479.1
5,584,526 A * 12/1996 Soldner ..... 296/146.15
5,688,016 A * 11/1997 Gold ..... 296/93
5,702,148 A 12/1997 Vaughan et al. ..... 296/146.9
5,704,173 A 1/1998 Repp et al.
5,732,509 A 3/1998 Buehler et al. ..... 49/440
5,735,089 A * 4/1998 Smith et al. ..... 52/202
5,743,047 A 4/1998 Bonne et al. ..... 49/490.1
5,752,352 A * 5/1998 Goto et al. ..... 52/208
5,758,459 A * 6/1998 Koike et al. ..... 52/235
5,779,956 A 7/1998 Hollingshead et al. ..... 264/138
5,791,088 A 8/1998 Martinelli et al. ..... 49/375
5,799,444 A 9/1998 Freimark et al.
5,803,527 A * 9/1998 Fujiya ..... 296/93
5,806,257 A * 9/1998 Cornils et al. ..... 52/208
5,809,707 A * 9/1998 Bargados et al. ..... 52/204.62
5,846,463 A 12/1998 Keeney et al. ..... 264/135
5,853,895 A 12/1998 Lewno ..... 425/425.6
5,935,356 A 8/1999 Soldner ..... 156/71
5,966,874 A 10/1999 Repp et al.
5,988,730 A * 11/1999 Bekaert ..... 296/146.15
5,996,284 A 12/1999 Freimark et al.
5,996,285 A 12/1999 Guillemet et al.
6,030,020 A * 2/2000 Malm ..... 296/93
6,082,674 A 7/2000 White et al.
6,128,860 A 10/2000 Repp et al.
6,134,851 A * 10/2000 Roze et al. ..... 52/204.597
6,138,414 A * 10/2000 Ohmori et al. ..... 49/441
6,206,453 B1 * 3/2001 Farrar et al. ..... 296/146.15
6,220,650 B1 4/2001 Davis et al. ..... 296/146.16
6,224,136 B1 * 5/2001 Takagi ..... 296/96.21
6,227,598 B1 * 5/2001 Ichioka et al. ..... 296/93
6,286,891 B1 9/2001 Gage et al.
6,287,402 B2 * 9/2001 Soldner ..... 156/71
6,298,606 B1 10/2001 Repp et al.
6,299,235 B1 10/2001 Davis et al. ..... 296/146.16
6,312,043 B1 11/2001 Blackburn et al.
6,389,763 B1 5/2002 Clauss
6,394,529 B2 5/2002 Davis et al. ..... 296/146.16
6,409,244 B1 * 6/2002 Nagahashi et al. ..... 296/93
6,425,215 B2 7/2002 Farrar
6,572,176 B2 6/2003 Davis et al.
6,585,311 B2 7/2003 Farrar et al.
6,591,552 B1 7/2003 Rasmussen
6,669,267 B1 12/2003 Lynam et al.
6,685,254 B2 2/2004 Emmons et al.
6,691,464 B2 2/2004 Nestell et al.
6,729,031 B2 5/2004 McKee
6,729,674 B2 5/2004 Davis et al.
6,793,269 B2 9/2004 Pugh et al.
6,817,144 B1 * 11/2004 Tavivian ..... 52/35
6,826,883 B2 * 12/2004 Guzman et al. ..... 52/716.5
6,830,290 B2 12/2004 DeGaillard
6,869,128 B2 * 3/2005 Farrar et al. ..... 296/146.16
6,902,224 B2 * 6/2005 Weinert et al. ..... 296/146.16
7,003,916 B2 2/2006 Nestell et al.
7,073,293 B2 7/2006 Galer
7,097,232 B2 8/2006 Beaudry et al.
7,146,769 B1 12/2006 Culverson
7,152,906 B1 12/2006 Farrer et al.
7,155,862 B2 1/2007 Bourque et al.
7,210,729 B2 * 5/2007 Hammaker et al. ..... 296/146.15
7,219,470 B2 5/2007 Lahnala
7,287,802 B2 10/2007 Dankert et al.
7,305,766 B1 12/2007 Timmermans
7,427,096 B2 9/2008 Snider
RE40,636 E 2/2009 Weinert et al.
7,568,316 B2 8/2009 Choby et al.
7,571,568 B2 * 8/2009 Ito et al. ..... 49/181
7,703,836 B2 4/2010 Snider et al.
8,245,462 B2 * 8/2012 Miethe et al. ..... 52/204.7
8,246,101 B2 * 8/2012 Cicala ..... 296/146.16
8,250,812 B2 * 8/2012 Hebert et al. ..... 49/413
8,272,168 B2 * 9/2012 Lahnala ..... 49/413
8,316,583 B2 * 11/2012 Lahnala ..... 49/408
8,322,073 B2 * 12/2012 Lewno ..... 49/130
8,322,075 B2 * 12/2012 Lahnala ..... 49/413
8,388,043 B2 * 3/2013 Lahnala ..... 296/146.16
2002/0095868 A1 * 7/2002 McCauley ..... 49/413
2002/0117874 A1 * 8/2002 Taylor ..... 296/178
2003/0070371 A1 * 4/2003 Kobrehel ..... 52/204.5
2003/0137161 A1 * 7/2003 Gillen ..... 296/146.16
2003/0182865 A1 * 10/2003 Nestell et al. ..... 49/374
2003/0209922 A1 * 11/2003 Emmons et al. ..... 296/203.01
2003/0213179 A1 * 11/2003 Galer ..... 49/413
2004/0020131 A1 * 2/2004 Galer et al. ..... 49/413
2004/0100121 A1 * 5/2004 Bourque et al. ..... 296/146.16
2005/0076573 A1 * 4/2005 Rivera ..... 49/413
2005/0161975 A1 * 7/2005 Nieminski et al. ..... 296/178
2006/0059799 A1 * 3/2006 Zimmer et al. ..... 52/204.1
2006/0101738 A1 * 5/2006 Lethers et al. ..... 52/204.51
2006/0107600 A1 * 5/2006 Nestell et al. ..... 49/413
2007/0157522 A1 * 7/2007 Hebert et al. ..... 49/413
2008/0122262 A1 * 5/2008 Cicala ..... 296/201
2008/0216410 A1 * 9/2008 Lahnala ..... 49/374
2009/0256398 A1 * 10/2009 Ota ..... 296/201
2009/0309391 A1 * 12/2009 Krause ..... 296/201
2010/0102597 A1 * 4/2010 Ellis ..... 296/201
2011/0192091 A1 * 8/2011 Smith et al. ..... 49/490.1
2012/0068500 A1 * 3/2012 Nania ..... 296/201
2012/0279136 A1 * 11/2012 Miethe et al. ..... 49/404

FOREIGN PATENT DOCUMENTS

FR 1166064 A * 11/1958
JP 06040251 A * 2/1994
WO WO 2012088287 A1 * 6/2012

* cited by examiner

132
Side Glass
Glazing Vinyl
Bottom Rail

130
Latch Rail
Side Glass
Glazing Vinyl 118
118a
140
142
128
115c
115
144
142b
142a
146

110
114
126
130
115
132
118
116
112
A
B
C

WINDOW ASSEMBLY FOR VEHICLE

CROSS REFERENCE TO RELATED APPLICATION

The present application claims the priority benefit of U.S. provisional application Ser. No. 61/232,250, filed Aug. 7, 2009, which is hereby incorporated herein by reference in its entirety.

FIELD OF THE INVENTION

The present invention relates to windows for vehicles and, more particularly, to window assemblies including window panels and frames for school buses or transit vehicles or the like.

BACKGROUND OF THE INVENTION

Vehicle window assemblies, such as for school buses and the like, typically include a frame that includes four aluminum side frame portions that are screwed or fastened together at the corners of the frame. The window panels, typically one fixed window panel and one movable window panel, are retained within channels along the frame portions while the frame portions are fastened together to form the window assembly. The assembly of such window assemblies typically requires multiple components and is typically labor intensive.

SUMMARY OF THE INVENTION

The present invention provides a window assembly or window module or window unit for a vehicle, such as a transit vehicle or school bus, that includes a frame and a fixed window panel at least partially encapsulated or surrounded by the frame and a movable window assembly that includes a movable window panel encapsulated by a movable frame portion and that is movable relative to the frame and the fixed window panel between opened and closed positions. The frame includes opposite side frame portions that receive respective side perimeter edge regions of the fixed window panel and that have a channel that slidably receives a co-extruded unitarily formed side slide rail of the movable frame portion of the movable window panel assembly.

The slide rail of the movable window panel assembly comprises a co-extruded rail that has a hard or rigid or semi-rigid plastic rail portion that is formed to be received in the channel of the side frame portion and that is formed to receive a side perimeter edge region of the movable window panel in a channel formed in the rail portion. The slide rail has a flexible window seal co-extruded in and along the channel of the rail portion for engaging and sealing against the movable window panel when the perimeter edge region of the movable window panel is at least partially received in the channel of the rail portion. A flexible rail seal is also co-extruded at the outer portions of the rail portion for sealing against and slidably engaging the channel formed in the side frame portion of the window frame when the slide rail is received in the channel of the fixed side frame portion. Optionally, a slip coat material may be co-extruded over at least a portion of the flexible rail seal to enhance sliding of the flexible rail seal along the channel of the side frame portion as the movable window panel is moved between its opened and closed positions.

Thus, the slide rail of the present invention comprises a single component that has different materials and elements co-extruded or tri-extruded to form a unitary slide rail member or element. The slide rail and movable window panel assembly of the present invention thus provides a single unitary slide rail and thus substantially reduces the number of components of the slide rail and thus reduces assembly processes in assembling the movable window panel assembly and the vehicle window assembly.

These and other objects, advantages, purposes and features of the present invention will become apparent upon review of the following specification in conjunction with the drawings.

DESCRIPTION OF THE PREFERRED EMBODIMENTS

Figure 1:
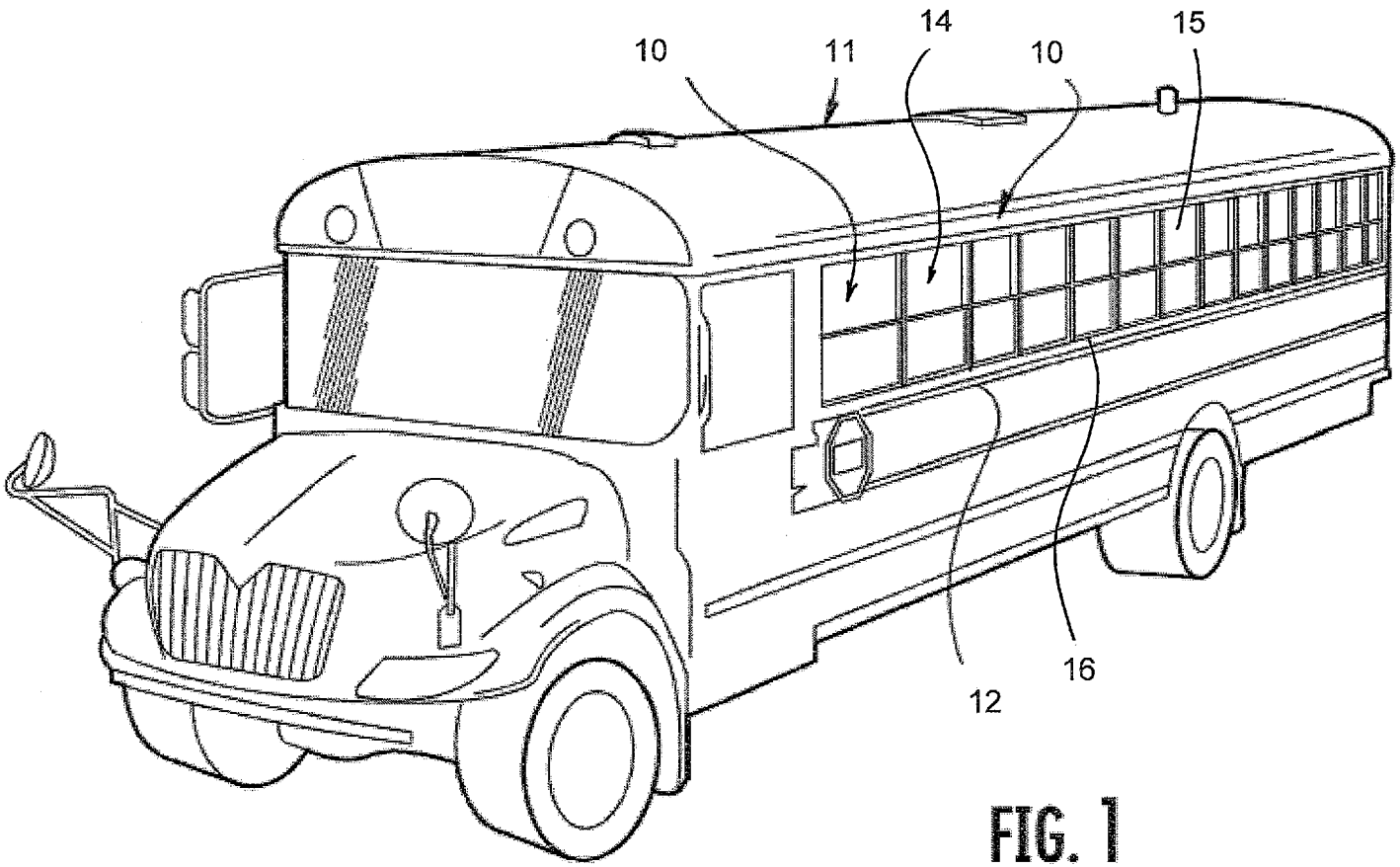
FIG. 1 is a perspective view of a school bus incorporating a plurality of window assemblies in accordance with the present invention.

Referring now to the drawings and the illustrative embodiments depicted therein, a window assembly or window module or window unit 10 may be mounted at an opening of a transit vehicle, such as a school bus 11 or the like (FIG. 1). Window assembly 10 comprises a modular window assembly that includes a fixed window pane or panel 12 fixedly attached to a perimeter frame 16, and a movable or slidable window assembly 14 that includes and supports a movable window pane or panel 15 and that slides or moves along perimeter frame 16, and that moves generally vertically relative to the fixed window panel 12 to open and close the window assembly. As shown in FIG. 1, a plurality of window assemblies or modules 10 may be installed along the side of the school bus. The window assemblies may be closely spaced next to one another and may provide a substantially continuous, flush row of window panels along the sides of the school bus. The fixed window panel and movable window panel may comprise any suitable material, such as glass or polycarbonate panels or substrates or the like, without affecting the scope of the present invention.

Figure 2B:
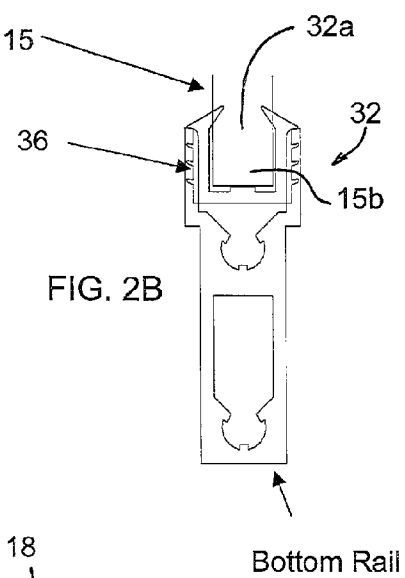
FIG. 2B is a sectional view of a lower cross rail of the movable window, taken along the line B-B in FIG. 2.
Figure 2A:
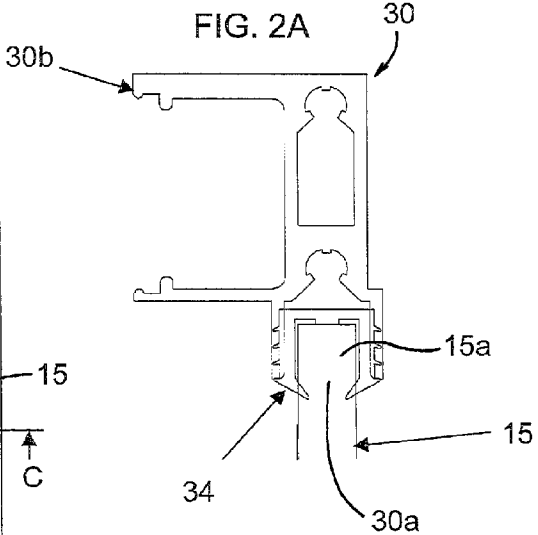
FIG. 2A is a sectional view of an upper cross rail of the movable window, taken along the line A-A in FIG. 2.
Figure 2C:
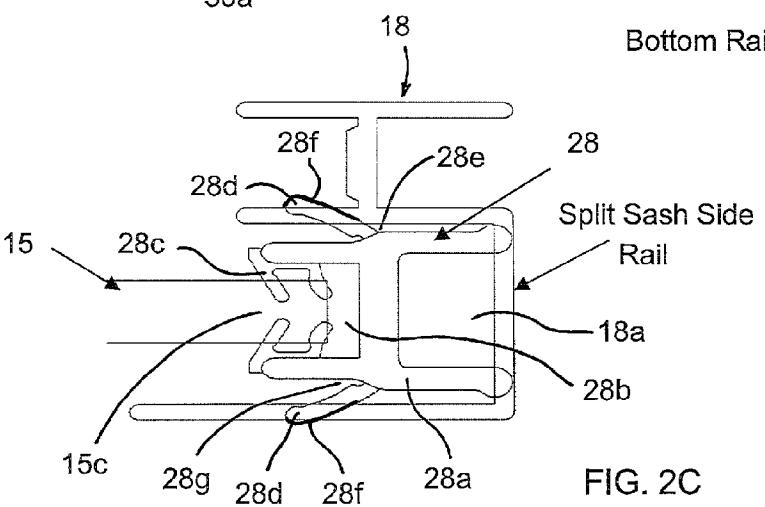
FIG. 2C is a sectional view of the tri-extruded vertical slide rail of the movable window, taken along the line C-C in FIG. 2.
Figure 2:
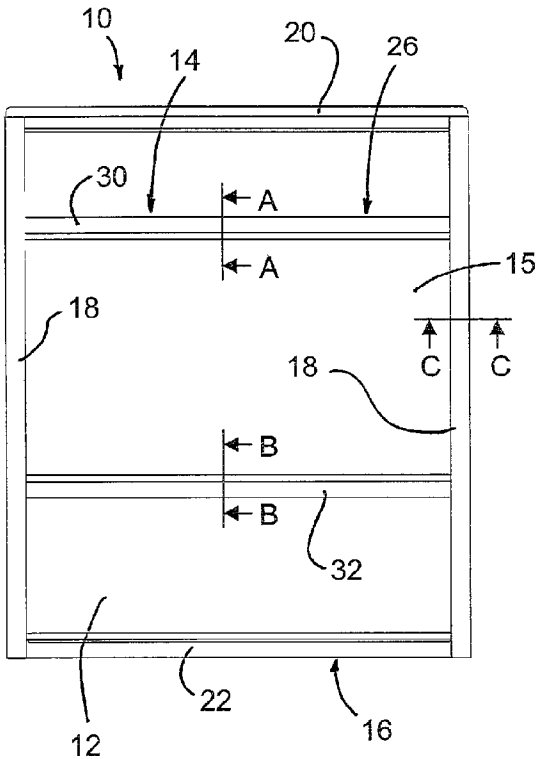
FIG. 2 is a plan view of a window assembly having a movable window with a tri-extruded vertical slide rail in accordance with the present invention.

As shown in FIG. 2, perimeter frame 16 includes a pair of generally vertical channel members or side frame members or split sash side rails 18 and a generally horizontal upper channel or frame member 20 and a generally horizontal lower channel or frame member 22. The frame members may be formed of any suitable material, and may be molded or extruded to the desired form (if each member is extruded, the ends of adjacent members may be joined together, such as via ultrasonic welding or bonding or the like). For example, the perimeter frame may comprise a substantially rigid material, such as a substantially rigid polymeric or plastic material, such as glass filled nylon, PVC, polyethylene terephthalate (PET), polypropylene, nylon, acrylonitrile-butadeine-styrene (ABS) or thermoplastic urethane (TPU) or the like. The perimeter frame may also or otherwise comprise, for example, a metallic material or a composite material, such as a filled polymeric or a metal member that is encapsulated in plastic or the like. The frame members may slidably or movably support the movable window unit or assembly 14. Optionally, the window assembly 10 may utilize aspects of the window assemblies described in U.S. Pat. No. 7,427,096, which is hereby incorporated herein by reference in its entirety.

Although shown and described as having a vertically movable window that is movable relative to a single fixed window panel, it is envisioned that aspects of the present invention may be suitable for use in other types of window assemblies having movable windows, such as horizontally movable windows or other vertically movable windows such as those described in U.S. Pat. No. 7,427,096, which is hereby incorporated herein by reference in its entirety. In the illustrated embodiment, movable window or window assembly 14 includes a glass or plastic window panel 15 that is surrounded or encompassed or encapsulated by a movable frame 26. Movable frame 26 includes a pair of generally vertical side slide rails or frame members 28 (FIGS. 2C and 3) and a generally horizontal upper channel or frame member 30 and a generally horizontal lower channel or frame member 32.

As shown in FIG. 2A, upper frame member 30 has a channel 30*a* along its lower edge for receiving the upper perimeter edge 15*a* of movable glass window panel 15, and includes a seal 34 disposed within the channel 30*a* and at least partially around and against the upper perimeter edge of the movable window panel to seal the window panel relative to the upper frame member. Similarly, lower frame member 32 (FIG. 2B) has a channel 32*a* along its upper edge for receiving the lower perimeter edge 15*b* of movable window panel 15, and includes a seal 36 disposed within the channel and at least partially around and against the lower perimeter edge of the movable window panel to seal the window panel relative to the lower frame member. As shown in FIG. 2A, the upper frame member 30 may include a latch rail 30*b* for receiving a latching element for selectively locking and releasing the movable window 14 at selected positions along the fixed window frame between its fully opened and fully closed positions. The lower and upper frame members may be attached to the lower and upper ends of the side slide rails, such as via fasteners or the like, to encapsulate the movable window panel 15 within the movable frame 26.

Figure 3:
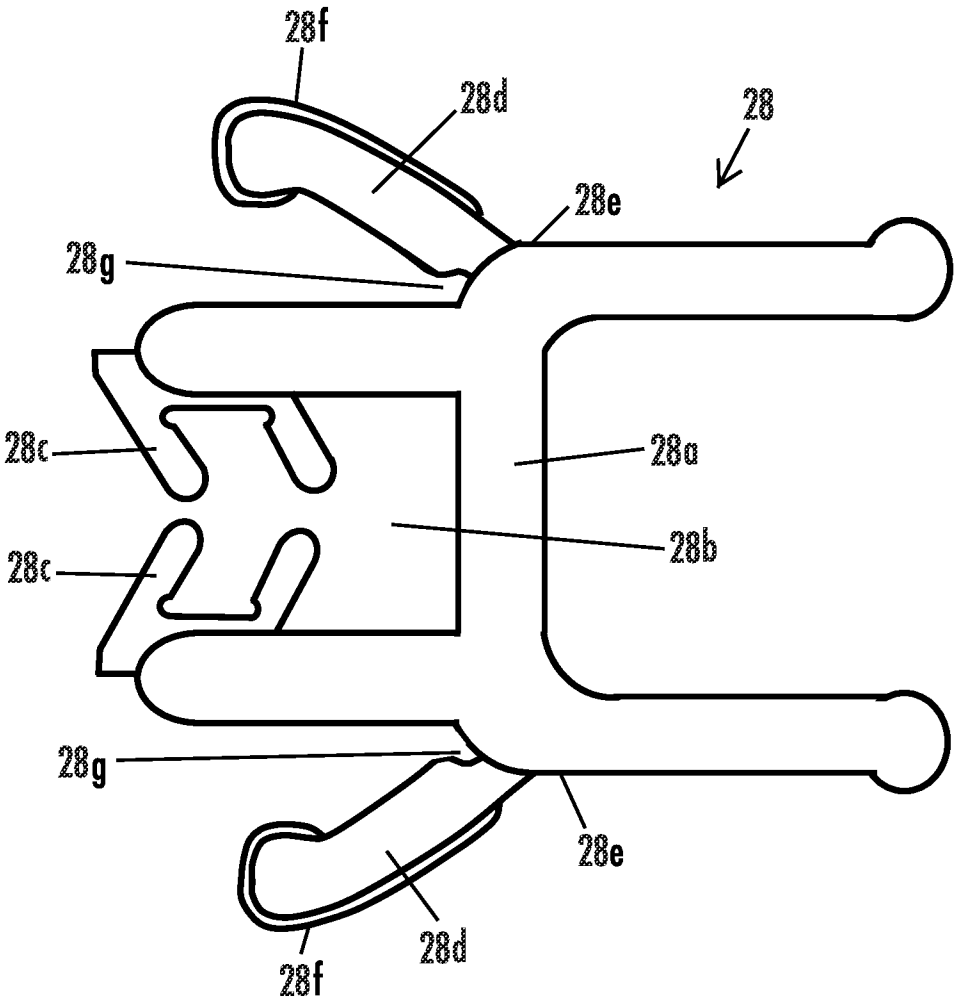
FIG. 3 is an enlarged sectional view of the tri-extruded vertical slide rail of FIG. 2C.

The side slide rails 28 of movable window 14 are slidably received in the side frame members 18 of the window frame 16, and comprise unitarily formed or co-extruded slide rails. As shown in FIGS. 2C and 3, side slide rail 28 comprises a hard or rigid or semi-rigid plastic rail portion 28*a* that is formed to be received in the channel 18*a* of the side frame portion 18 and that is formed to receive a side perimeter edge region 15*c* of the movable window panel 15 in a channel 28*b* formed in the rail portion 28*a*. The slide rail 28 has a flexible window seal 28*c* co-extruded in the channel 28*b* of the rail portion 28*a* (such as along the inner or opposed surfaces of the legs of the rail portion that form the generally U-shaped channel 28*b*) for engaging and sealing against the side perimeter edge region 15*c* of the movable window panel 15 when the perimeter edge region 15*c* of the movable window panel 15 is received in the channel 28*a* of the rail portion 28. A flexible rail seal 28*d* is also co-extruded at the outer portions or surfaces 28*e* of the rail portion 28*a* for sealing against and slidably engaging the channel 18*a* formed in the side frame portion 18 of the window frame 16. A slip coat material 28*f* may be disposed at and/or co-extruded over at least a portion of the flexible rail seal 28*d* to enhance sliding of the flexible rail seal 28*d* along the channel 18*a* of the side frame portion 18 as the movable window 14 is moved between its opened and closed positions. Optionally, and as shown in FIGS. 2C and 3, the flexible rail seals 28*d* may be formed with a narrowed section or portion 28*g* to enhance flexing of the flexible seal as the slide rail is received in or inserted in the channel 18*a* of the side frame portion 18.

Thus, the present invention provides for a co-extruded or tri-extruded slide rail for a movable window unit or assembly, such as for a vehicle, such as for a school bus or other bus or transit or public transit vehicle. The rail portion 28*a* may be extruded or formed of a substantially rigid polymeric material or plastic material, such as, for example, a glass filled polypropylene material or a calcium carbonate filled polypropylene material (such as a 40 percent calcium carbonate filled polypropylene material or the like). The flexible window seals 28*c* and flexible rail seals 28*d* are co-extruded along the rail portion and may comprise the same material as one another, such as a softer or resilient sealing material, such as a rubber or elastomeric or thermoplastic vinyl (TPV) material (such as a material preferably having less than a 80 Shore A durometer, preferably less than 60 Shore A durometer). Optionally, the flexible window seals and flexible rail seals may comprise any suitable material, such as, for example, a polypropylene material (PPE) or EPDM material, and/or may utilize aspects of the seals and seal materials described in U.S. Pat. Nos. 6,220,650; 6,299,235; 6,394,529; 6,572,176; and 6,729,674, which are hereby incorporated herein by reference in their entireties. The slip coat 28*f* is co-extruded over at least a portion of the flexible rail seal 28*d* and may comprise a thin layer of a slick or low coefficient of friction material, such as a TEFLON® type material or the like. The coated flexible rail seals 28*d* thus may readily slide along the channel 18*a* of the side frame portions and may function to maintain the slide rail 28 generally centered within the channel 18*a* as the movable window 14 is moved between its opened and closed positions and/or locked or retained at any given position therebetween.

Figures 4, 4A, 4B, 4C:
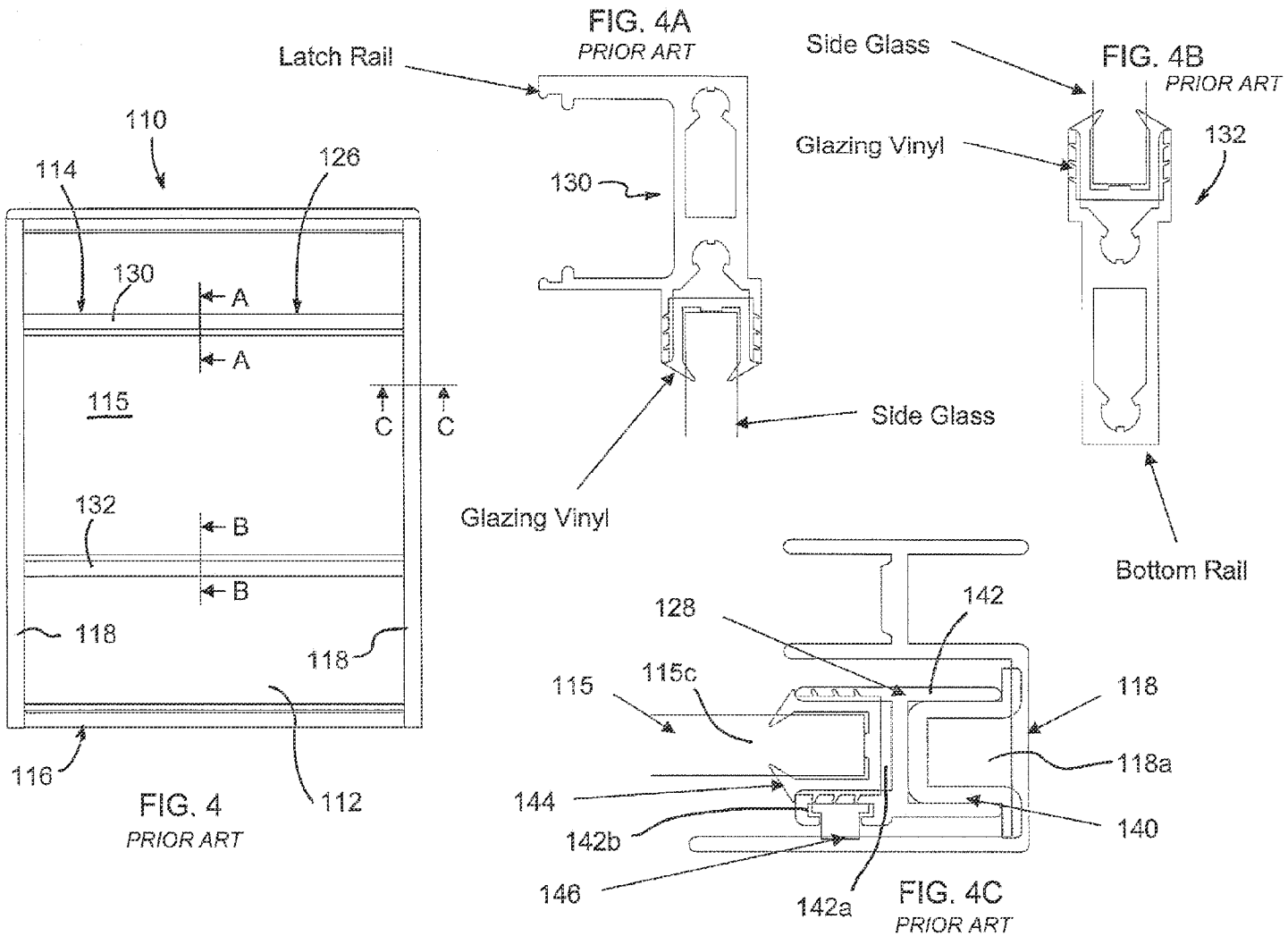
FIG. 4B PRIOR ART
FIG. 4A PRIOR ART
FIG. 4C PRIOR ART
FIG. 4 PRIOR ART
FIG. 4 is a plan view of a window assembly having a multi-component frame.
FIG. 4A is a sectional view of an upper cross rail of a movable window of the window assembly, taken along the line A-A in FIG. 4.
FIG. 4B is a sectional view of a lower cross rail of the movable window of the window assembly, taken along the line B-B in FIG. 4.
FIG. 4C is a sectional view of a vertical rail assembly of the movable window of the window assembly, taken along the line C-C in FIG. 4.

Thus, the present invention provides for a substantial reduction in the number of parts typically required or utilized in a side slide rail for a movable window assembly. For example, and with reference to FIGS. 4 and 4A-C, a typical school bus window assembly 110 may include a fixed window pane or panel 112 fixedly attached to a perimeter frame 116, and a movable or slidable window assembly 114 that includes and supports a movable window pane or panel 115 and that slides or moves along perimeter frame 116, and that moves generally vertically relative to the fixed window panel 112 to open and close the window assembly, such as in a similar manner as movable window 14, discussed above. Like movable window 14, discussed above, movable window 114 includes a glass or plastic window panel 115 that is surrounded or encompassed or encapsulated by a movable frame 126. Movable frame 126 includes a pair of generally vertical side slide rails or frame members 128 and a generally horizontal upper channel or frame member 130 and a generally horizontal lower channel or frame member 132. As can be seen in FIGS. 4A and 4B, upper and lower frame members 130, 132 may be substantially similar to upper and lower frame members 30, 32, discussed above, such that a detailed discussion of these frame members need not be repeated herein.

As shown in FIG. 4C, side rail or frame member 128 of known movable window 114 comprises multiple components that need to be assembled together before the movable window frame can be assembled about the perimeter of the movable window panel. In the illustrated embodiment, side rail 128 includes a plastic guide 140 that is received in and retained in the channel 118*a* of the side frame 118 and an aluminum base portion 142 that is attached to or that receives guide portion so as to be disposed within the channel 118*a*. Base portion 142 is a generally H-shaped element that receives guide portion 140 at one end and the perimeter edge 115*c* of the movable window panel 115 at its other end. A separate window seal 144 is disposed within and adhered within the channel 142*a* of base portion 142 to seal against the perimeter edge 115*c* of movable window panel 115. A separate weather strip or seal 146 is disposed within and adhered within a channel 142*b* formed along an outside surface of the base portion 142 to seal the base portion relative to the fixed side frame 118. Thus, a typical slide rail for a typical movable window assembly has four distinct components (the plastic guide, the metal base, the elastomeric or rubber window seal and the weather strip), and each part may comprise a different material. Thus, not only are the components costly as compared to the unitary slide rail of the present invention, but such conventional slide rails are labor intensive to assemble, and typically require adhesive and/or fasteners to adhere or bond or attach the different components together.

Therefore, the present invention provides a window assembly or multiple window assemblies for installation at or attachment to the sides of a vehicle, such as a school bus or the like. The window assemblies are modular window assemblies that may be readily attached to the school bus. The side slide rail of the movable window assembly comprises a unitary construction that is co-extruded or tri-extruded out of three different types of materials. The tri-extruded slide rail thus has no separate parts and thus requires no assembly. The tri-extruded slide rails thus may be readily attached or fastened to the upper and lower frame members to encapsulate the movable window panel, whereby the movable window assembly may be installed at the fixed window frame and the window assembly may be mounted to the side of a vehicle or school bus.

Changes and modifications to the specifically described embodiments may be carried out without departing from the principles of the present invention, which is intended to be limited only by the scope of the appended claims as interpreted according to the principles of patent law.

The invention claimed is:

1. A window assembly for a vehicle, said window assembly comprising:

a frame configured to mount to a vehicle;

a fixed window panel affixed to a portion of said frame;

a movable window assembly comprising a movable window panel circumscribed by a movable frame, said movable frame having opposite end frame members and a pair of slide rail members, wherein said movable window assembly is movable relative to said fixed window panel and said frame between an opened position and a closed position;

wherein said slide rail members are slidably received in respective channels along opposite portions of said frame;

wherein each of said slide rail members comprises a co-extruded slide rail of unitary or one-piece construction comprising (a) a semi-rigid or rigid rail portion, (b) a flexible window seal co-extruded with said rail portion for sealing against said movable window panel and (c) a flexible sliding seal co-extruded with said rail portion for slidably engaging said opposite portions of said frame when said movable window assembly is assembled to said frame and is moved between said opened and closed positions;

wherein said flexible window seal engages and seals against said movable window panel when an edge region of said movable window panel is at least partially received at said rail portion, and wherein said movable window panel and said rail portion move in tandem when said movable window assembly is moved between said opened and closed positions; and wherein said sliding seal protrudes from said rail portion of said slide rail member such that, when said rail portion of said slide rail member is at least partially received in said channel of said frame, said flexible sliding seal engages at least one wall of said channel of said frame and slides along said at least one wall of said channel when said movable window assembly is moved between said opened and closed positions.

2. The window assembly of claim 1, wherein said window assembly is configured to mount at a side of a bus.

3. The window assembly of claim 1, wherein said movable window assembly is vertically movable relative to said frame and fixed window panel when said window assembly is mounted to the vehicle, and wherein said opposite end frame members comprise upper and lower frame members and said pair of slide rail members comprise side slide rail members.

4. The window assembly of claim 1, wherein said sliding seal and said window seal comprise at least one of a rubber material, an elastomeric material, a thermoplastic vinyl material, a polypropylene material, an EPDM material, a material having a hardness of less than a 80 Shore A durometer and a material having a hardness of less than 60 Shore A durometer.

5. The window assembly of claim 1, wherein each of said slide rail members further comprises a slip coat layer co-extruded on at least a portion of said sliding seal.

6. The window assembly of claim 5, wherein said sliding seal comprises a resilient sealing material and wherein said slip coat layer comprises a thin layer of a material having a reduced coefficient of friction relative to said sealing material.

7. The window assembly of claim 6, wherein said slip coat layer comprises a thin layer of a low coefficient of friction material.

8. The window assembly of claim 1, wherein said rail portion is received in a U-shaped channel of said frame and wherein said flexible sliding seal is co-extruded along opposite side portions of said rail portion for engaging opposite walls of said U-shaped channel of said frame.

9. The window assembly of claim 8, wherein said rail portion comprises a U-shaped window receiving portion for receiving an edge region of said movable window therein and wherein said flexible window seal is co-extruded along inner wall portions of said window receiving portion for engaging and sealing against said movable window panel.

10. The window assembly of claim 9, wherein said sliding seal is co-extruded along outer wall portions of said window receiving portion and extends outwardly therefrom for slidably engaging said opposite portions of said frame when said movable window assembly is assembled to said frame and is moved between said opened and closed positions.

11. A window assembly for a vehicle, said window assembly comprising:

a frame configured to mount to a vehicle;

a fixed window panel affixed to a portion of said frame;

a movable window assembly comprising a movable window panel circumscribed by a movable frame, said movable frame having opposite end frame members, and a pair of slide rail members, wherein said movable window assembly is movable relative to said fixed window panel between an opened position and a closed position;

wherein said slide rail members are slidably received in respective channels along opposite portions of said frame;

wherein each of said slide rail members comprises a co-extruded slide rail of unitary or one-piece construction and comprising (a) a semi-rigid or rigid rail portion that is at least partially received in a U-shaped channel of said frame, (b) a flexible window seal co-extruded with said rail portion and along a U-shaped channel of said slide rail for sealing against a portion of said movable window panel that is received in said U-shaped channel of said slide rail, and (c) a flexible sliding seal co-extruded with and along a portion of said rail portion for slidably engaging said rail portion of said frame when said movable window assembly is assembled to said frame and is moved between said opened and closed positions;

wherein said movable window panel and said rail portion move in tandem when said movable window assembly is moved between said opened and closed positions; and wherein said sliding seal protrudes from said rail portion of said slide rail member such that, when said rail portion is at least partially received in said U-shaped channel of said frame, said flexible sliding seal engages at least one wall of said U-shaped channel of said frame and slides along said at least one wall of said U-shaped channel when said movable window assembly is moved between said opened and closed positions.

12. The window assembly of claim 11, wherein said window assembly is configured to mount at a side of a bus.

13. The window assembly of claim 11, wherein said flexible sliding seal is co-extruded along opposite side portions of said U-shaped channel of said rail portion for engaging opposite walls of said U-shaped channel of said frame.

14. The window assembly of claim 11, wherein each of said slide rail members further comprises a slip coat layer co-extruded on at least a portion of said sliding seal.

15. The window assembly of claim 14, wherein said sliding seal comprises a resilient sealing material and wherein said slip coat layer comprises a thin layer of a material having a reduced coefficient of friction relative to said sealing material.

16. A window assembly for a vehicle, said window assembly comprising:

a frame configured to mount to a vehicle;

a fixed window panel affixed to a portion of said frame;

a movable window assembly comprising a movable window panel circumscribed by a movable frame, said movable frame having opposite end frame members, and a pair of slide rail members, wherein said movable window assembly is movable relative to said fixed window panel between an opened position and a closed position;

wherein said slide rail members are slidably received in respective U-shaped channels along opposite portions of said frame;

wherein each of said slide rail members comprises a co-extruded slide rail of unitary or one-piece construction comprising (a) a semi-rigid or rigid rail portion configured to be at least partially received in said U-shaped channel of said frame, wherein said rail portion comprises a U-shaped channel for receiving a portion of said movable window therein, (b) a flexible window seal co-extruded with and along inner wall portions of said U-shaped channel of said rail portion for sealing against said portion of said movable window panel received therein, and (c) a flexible sliding seal co-extruded with and along another portion of said rail portion for engaging at least one wall of said U-shaped channel of said frame;

wherein said movable window panel and said rail portion move in tandem when said movable window assembly is moved between said opened and closed positions; and wherein said sliding seal protrudes from said rail portion of said slide rail member such that, when said rail portion is at least partially received in said U-shaped channel of said frame, said flexible sliding seal engages said at least one wall of said U-shaped channel of said frame and slides along said at least one wall of said U-shaped channel when said movable window assembly is moved between said opened and closed positions; and wherein each of said slide rail members comprises a slip coat layer at at least a portion of said sliding seal for slidably engaging said at least one wall of said U-shaped channel of said frame when said movable window assembly is assembled to said frame and is moved between said opened and closed positions.

17. The window assembly of claim 16, wherein said sliding seal comprises a resilient sealing material and wherein said slip coat layer comprises a thin layer of a material having a reduced coefficient of friction relative to said sealing material.

18. The window assembly of claim 16, wherein said slip coat layer is co-extruded along said at least a portion of said sliding seal.

19. The window assembly of claim 16, wherein said flexible sliding seal is co-extruded with and along at least one wall of said U-shaped channel of said rail portion for engaging said at least one wall of said U-shaped channel of said frame.

20. The window assembly of claim 16, wherein said flexible sliding seal is co-extruded with and along opposite walls of said U-shaped channel of said rail portion for engaging opposite walls of said U-shaped channel of said frame.

* * * * *

UNITED STATES PATENT AND TRADEMARK OFFICE

CERTIFICATE OF CORRECTION

PATENT NO. : 8,495,841 B2
APPLICATION NO. : 12/850871
DATED : July 30, 2013
INVENTOR(S) : Gary DeGroff It is certified that error appears in the above-identified patent and that said Letters Patent is hereby corrected as shown below:

In the Claims

Column 7
Line 14, Claim 11, Delete "and" after "construction"

Signed and Sealed this
Thirty-first Day of December, 2013

Margaret A. Focarino

Margaret A. Focarino
*Commissioner for Patents of the United States Patent and Trademark Office*